US011371522B2

(12) United States Patent
Xie et al.

(10) Patent No.: US 11,371,522 B2
(45) Date of Patent: Jun. 28, 2022

(54) PERMANENT MAGNET DIRECT-DRIVE SLURRY PUMP BASED ON GAS FILM DRAG REDUCTION

(71) Applicants: China University of Mining and Technology, Jiangsu (CN); SHANDONG ZHANGQIU BLOWER CO., LTD., Shandong (CN)

(72) Inventors: Fangwei Xie, Jiangsu (CN); Shupeng Fang, Jiangsu (CN); Zuzhi Tian, Jiangsu (CN); Gang Shen, Jiangsu (CN); Zhencai Zhu, Jiangsu (CN); Haifang Zhang, Jiangsu (CN); Honglei Li, Jiangsu (CN); Chunjie Xu, Jiangsu (CN); Wancai Zhou, Jiangsu (CN)

(73) Assignees: China University of Mining and Technology, Jiangsu (CN); SHANDONG ZHANGQIU BLOWER CO., LTD., Shandong (CN)

( * ) Notice: Subject to any disclaimer, the term of this patent is extended or adjusted under 35 U.S.C. 154(b) by 0 days.

(21) Appl. No.: 17/425,334

(22) PCT Filed: Jul. 2, 2020

(86) PCT No.: PCT/CN2020/099861
§ 371 (c)(1),
(2) Date: Jul. 23, 2021

(87) PCT Pub. No.: WO2021/184592
PCT Pub. Date: Sep. 23, 2021

(65) Prior Publication Data

US 2022/0154733 A1 May 19, 2022

(30) Foreign Application Priority Data

Mar. 20, 2020 (CN) ..... 202010202205.3

(51) Int. Cl.
*F04D 29/22* (2006.01)
*F04D 29/68* (2006.01)
(Continued)

(52) U.S. Cl.
CPC ..... *F04D 29/2222* (2013.01); *F04D 7/04* (2013.01); *F04D 13/021* (2013.01); *F04D 13/06* (2013.01);
(Continued)

(58) Field of Classification Search
CPC .. F04D 13/0613; F04D 29/588; F04D 13/086; F04D 29/061; F04D 29/5806;
(Continued)

(56) References Cited

U.S. PATENT DOCUMENTS 2,906,208 A * 9/1959 White ..... F04D 29/2222 417/357
3,135,211 A * 6/1964 Pezzillo ..... F04D 13/0613 417/357
(Continued)

FOREIGN PATENT DOCUMENTS

CN 201661481 12/2010
CN 103195744 7/2013
(Continued)

OTHER PUBLICATIONS

"International Search Report (Form PCT/ISA/210) of PCT/CN2020/099861" dated Dec. 21, 2020, pp. 1-5.
(Continued)

*Primary Examiner* — Peter J Bertheaud
(74) *Attorney, Agent, or Firm* — JCIPRNET

(57) ABSTRACT

Disclosed is a permanent magnet direct-drive slurry pump based on gas film drag reduction, which includes a permanent magnet motor, a main shaft, an impeller, and a valve block. The permanent magnet motor includes a housing, a
(Continued)

stator core, stator windings, a rotor core, and a permanent magnet. The rotor core and the impeller share the main shaft, and an airflow channel is provided inside the main shaft. The impeller includes a front cover plate, a back cover plate, and blades. The blades are modularly manufactured, and blade gas jet holes and hemispherical pits are provided on the pressure surface. The airflow channel in the main shaft is communicated with the blade gas-jet holes. The valve block is disposed at the tail end of the main shaft so as to control gas exhaust and prevent liquid from entering the shaft. The present invention has such advantages as a small size, high efficiency, and strong wear resistance.

10 Claims, 5 Drawing Sheets

(51) Int. Cl.

| | |
|---|---|
| ***F04D 7/04*** | (2006.01) |
| ***F04D 13/06*** | (2006.01) |
| ***F04D 29/62*** | (2006.01) |
| ***F04D 29/20*** | (2006.01) |
| ***F04D 29/043*** | (2006.01) |
| ***F04D 29/12*** | (2006.01) |
| ***F04D 29/58*** | (2006.01) |
| ***F04D 29/06*** | (2006.01) |
| ***F04D 13/08*** | (2006.01) |
| ***F04D 29/28*** | (2006.01) |
| ***F04D 29/10*** | (2006.01) |
| ***F04D 13/02*** | (2006.01) |
| ***F04D 29/66*** | (2006.01) |
| ***F04D 29/24*** | (2006.01) |

(52) U.S. Cl.
CPC ..... *F04D 13/0613* (2013.01); *F04D 13/0646* (2013.01); *F04D 13/086* (2013.01); *F04D 29/043* (2013.01); *F04D 29/061* (2013.01); *F04D 29/106* (2013.01); *F04D 29/126* (2013.01); *F04D 29/128* (2013.01); *F04D 29/20* (2013.01); *F04D 29/22* (2013.01); *F04D 29/2205* (2013.01); *F04D 29/24* (2013.01); *F04D 29/242* (2013.01); *F04D 29/286* (2013.01); *F04D 29/5806* (2013.01); *F04D 29/588* (2013.01); *F04D 29/628* (2013.01); *F04D 29/669* (2013.01); *F04D 29/688* (2013.01)

(58) Field of Classification Search
CPC ..... F04D 13/06; F04D 29/586; F04D 29/043; F04D 29/128; F04D 29/106; F04D 29/126; F04D 29/669; F04D 7/04; F04D 13/0646; F04D 13/021; F04D 29/688; F04D 29/20; F04D 29/2222; F04D 29/628; F04D 29/22; F04D 29/2205; F04D 29/24; F04D 29/242
See application file for complete search history.

(56) References Cited

U.S. PATENT DOCUMENTS

| | | | | | |
|---|---|---|---|---|---|
| 3,220,350 | A | * | 11/1965 | White | F04D 13/0613 417/357 |
| 3,318,253 | A | * | 5/1967 | Campolong | F04D 13/0613 165/104.31 |
| 3,413,925 | A | * | 12/1968 | Campolong | F04D 29/0416 417/357 |
| 3,652,186 | A | * | 3/1972 | Carter | F04D 29/608 415/110 |
| 4,115,038 | A | * | 9/1978 | Litzenberg | H02K 5/128 417/357 |
| 4,234,293 | A | * | 11/1980 | Lightle | F04D 29/042 417/357 |
| 5,129,795 | A | * | 7/1992 | Hyland | H02K 7/09 417/423.12 |

FOREIGN PATENT DOCUMENTS

| | | |
|---|---|---|
| CN | 103629118 | 3/2014 |
| CN | 208021696 | 10/2018 |
| CN | 109185223 | 1/2019 |
| CN | 109622153 | 4/2019 |
| CN | 111288012 | 6/2020 |
| SU | 542027 | 1/1977 |

OTHER PUBLICATIONS

"Written Opinion of the International Searching Authority (Form PCT/ISA/237) of PCT/CN2020/099861," dated Dec. 21, 2020, with English translation thereof, pp. 1-10.

* cited by examiner

PERMANENT MAGNET DIRECT-DRIVE SLURRY PUMP BASED ON GAS FILM DRAG REDUCTION

CROSS-REFERENCE TO RELATED APPLICATION

This application is a 371 of international application of PCT application serial no. PCT/CN2020/099861, filed on Jul. 2, 2020, which claims the priority benefit of China application no. 202010202205.3, filed on Mar. 20, 2020. The entirety of each of the above mentioned patent applications is hereby incorporated by reference herein and made a part of this specification.

BACKGROUND

Technical Field

The present invention relates to the field of slurry pumps, and in particular, to a permanent magnet direct-drive slurry pump based on gas film drag reduction.

Description of Related Art

China is a major producer and consumer of slurry pumps. The working environment of the slurry pump leads to serious wear and tear of its flow passage component. Moreover, the efficiency of domestic slurry pumps is generally lower than that of foreign products, causing a lot of economic and energy losses every year. Therefore, in order to improve this situation, it is necessary to propose a new solution.

The slurry pump is an impurity pump that delivers a solid-liquid two-phase flow, and has an efficiency generally lower that of a clear water pump because of the existence of solid particles. Especially, during delivery of high-concentration particles and corrosive slurry, with the high-speed rotation of an impeller, the solid particles impact the blades at high frequency, and the slurry washes and corrodes the wall surface of the flow passage component, resulting in wear of the impeller and reduced efficiency, or even failure. Based on a gas film drag reduction theory, a mixed layer of a gas film and water is formed on the wall surface by changing the flow field of the wall surface, thus greatly reducing fluid drag. Further, the existence of the film layer reduces the high-frequency impact from the solid particles and the corrosion and wear caused by the slurry. Chinese patent application No. CN109185223A discloses a "bionic design method for centrifugal pumps to achieve drag and noise reduction performance", where a plurality of V-shaped sharkskin-like grooves is provided near a blade exit on a blade working face of an impeller. The structural design of the V-shaped grooves can effectively reduce the impeller working resistance and improve the working efficiency of a centrifugal pump. Chinese patent application No. CN103195744A discloses a "low-specific-speed impeller based on groove drag reduction", where a series of grooves are made on the pressure and suction surfaces of the blades by machining or casting, thus reducing the loss of turbulence kinetic energy from the surface of the impeller. The foregoing two solutions can both reduce the working resistance of the impeller. However, as the working conditions of the slurry pump changes, parameters, such as groove positions and size, are unable to adapt to the changing working conditions at any time, so that the slurry pump has great limitations in impeller drag reduction and efficiency improvement, and does not have the function of resistance to slurry corrosion.

SUMMARY

In view of the deficiencies in the prior art, the present invention aims to provide a permanent magnet direct-drive slurry pump based on gas film drag reduction, which has a small size, high efficiency, and strong wear resistance.

To solve the foregoing technical problem, the present invention adopts the following technical solution:

The present invention provides a permanent magnet direct-drive slurry pump based on gas film drag reduction, which includes a motor housing of which a front end and a rear end are respectively disposed with a motor front cover and a motor back cover, where a pump body is further fixed on the front end of the motor housing and a pumping chamber is formed between the pump body and the motor front cover; a rotatable main shaft is disposed between the motor front cover and the motor back cover, an airflow channel penetrating from front to back is provided inside the main shaft, and a rotor core and a permanent magnet are successively sleeved on the outer wall of a middle portion of the main shaft from inside out; a stator core corresponding to the rotor core is disposed on the inner wall of the motor housing, and two ends of the stator core are respectively disposed with stator windings; a front end of the main shaft extends into the pumping chamber and is threaded-fastened with an impeller of the pump body, and a rear end face of the main shaft extends out of the motor back cover; a back cover plate of the impeller is provided with a threaded hole which is in a screw-thread fit with the front end of the main shaft; a valve block which partitions the threaded hole into a first gas compartment and a second gas compartment is threaded-fastened in the threaded hole; several evenly distributed blades are disposed at a lateral side of the back cover plate that is close to the main shaft, and a blade gas inlet passage and several blade gas exhaust passages that are mutually communicated are disposed on each blade; several first gas exhaust ports and second gas exhaust ports that respectively penetrate through the first gas compartment and the pumping chamber are provided in the back cover plate; several third gas vents penetrating through the blade gas inlet passage and the first gas compartment are further provided on the back cover plate; and the pump body and the rear end of the motor housing are both fixed on the base frame.

Preferably, the valve block includes a block body of which a middle portion is provided with a T-shaped through hole penetrating from front to back, and a slidable three-way pipe which fits into the T-shaped through hole is disposed in the T-shaped through hole; a spring support is fixed at the front end port of the T-shaped through hole, a spring is fixedly connected between the spring support and the three-way pipe, and a valve port is provided at the middle of the spring support; a three-way gas hole is provided in the three-way pipe, and two longitudinally symmetrical L-shaped gas passages which are separately communicated with the three-way gas hole and the second gas compartment are provided in the block body; and a slidable valve core is further disposed at the rear end of the T-shaped through hole, and an end of the valve core that is far away from the three-way pipe is disposed with an arc-shaped cap capable of covering the end port of the airflow channel in the main shaft.

Preferably, the front end of the main shaft is rotatably connected to the motor front cover via a first shaft sleeve and a first bearing, and the rear end of the main shaft is rotatably connected to the motor back cover via a second shaft sleeve and a second bearing.

Preferably, an insertion rod is threaded-fastened at an end of the blade gas inlet passage that is close to the back cover plate, and a hollow insertion rod gas passage is provided in the insertion rod; a rubber sleeve is sleeved on an end of the insertion rod that is far away from the blade gas inlet passage, and the insertion rod is nested into its corresponding third gas vent.

Preferably, the first gas exhaust ports and the second gas exhaust ports are disposed at the front edge between two adjacent blades.

Preferably, the blade gas exhaust passages are disposed at the front edge of a pressure surface of the blade, and multiple rows of hemispherical pits are provided from a middle section to the tail edge of the blade.

Preferably, a plurality of blade gas-jet holes is provided in each blade gas exhaust passage.

Preferably, a bottom end face of the blade is disposed with a boss, and a T-shaped groove which fits into the boss is disposed on the back cover plate; and several mounting holes for axially fixing the blade are further provided on the back cover plate.

Preferably, there are 5 to 8 blades.

Preferably, gas outlets of the first gas exhaust ports and the second gas exhaust ports are all disposed at the hub of the cover plate and arranged in two layers from inside to outside, and the two-layer gas outlets are circumferentially evenly distributed on the hub right opposite a flow channel between two adjacent blades.

The present invention achieves the following beneficial effects:

1. A permanent magnet motor and the slurry pump are coaxially designed, which reduces the size of the whole machine, simplifies the structure, and reduces the power consumption.

2. An assembly-mode impeller is used, and the blades are modularly designed and manufactured, thus facilitating disassembly and maintenance of the impeller and also facilitating appropriate arrangement of blade flow channels.

3. The gas film drag reduction theory is applied for drag reduction and efficiency improvement, and wear reduction and corrosion prevention of the slurry pump, thus significantly improving the performance and service life of the slurry pump.

BRIEF DESCRIPTION OF THE DRAWINGS

To describe the technical solutions in the embodiments of the present invention or in the prior art more clearly, the following briefly introduces the accompanying drawings required for describing the embodiments or the prior art. Apparently, the accompanying drawings in the following description show merely some embodiments of the present invention, and those of ordinary skill in the art may still derive other drawings from these accompanying drawings without creative efforts.

MEANINGS OF NUMERALS

1, Pump body; 2, Impeller; 2-1, Blade; 3, Motor housing; 4, Stator winding; 5, Stator core; 6, Permanent magnet; 7, Rotor core; 8, Airflow channel; 9, Main shaft; 10, Motor back cover; 11, Gas inlet; 12, Front cover plate; 13, Back cover plate; 14, Motor front cover; 15, First bearing; 16, First shaft sleeve; 17, Base frame; 18, Second shaft sleeve; 19, Second bearing; 20, First gas exhaust port; 21, Second gas exhaust port; 22, First gas compartment; 23, Valve block; 24, Valve port; 25, Spring; 26, Three-way gas hole; 27, L-shaped gas passage; 28, Second gas compartment; 29, Spring support; 30, Three-way pipe; 31, Valve core; 32, Third gas vent; 33, Rubber sleeve; 34, Insertion rod; 35, Insertion rod gas passage; 36, Blade gas inlet passage; 37, Blade gas exhaust passage; 38, Blade gas-jet hole; 39, Hemispherical pit; 40, T-shaped groove; 41, Mounting hole; 42, Boss.

DESCRIPTION OF THE EMBODIMENTS

The technical solutions in the embodiments of the present invention are clearly and completely described below with reference to the accompanying drawings of the embodiments of the present invention. Apparently, the described embodiments are some rather than all of the embodiments of the present invention. Based on the described embodiments of the present invention, other embodiments acquired by those of ordinary skill in the art without creative effort all belong to the protection scope of the present invention.

Figure 1:
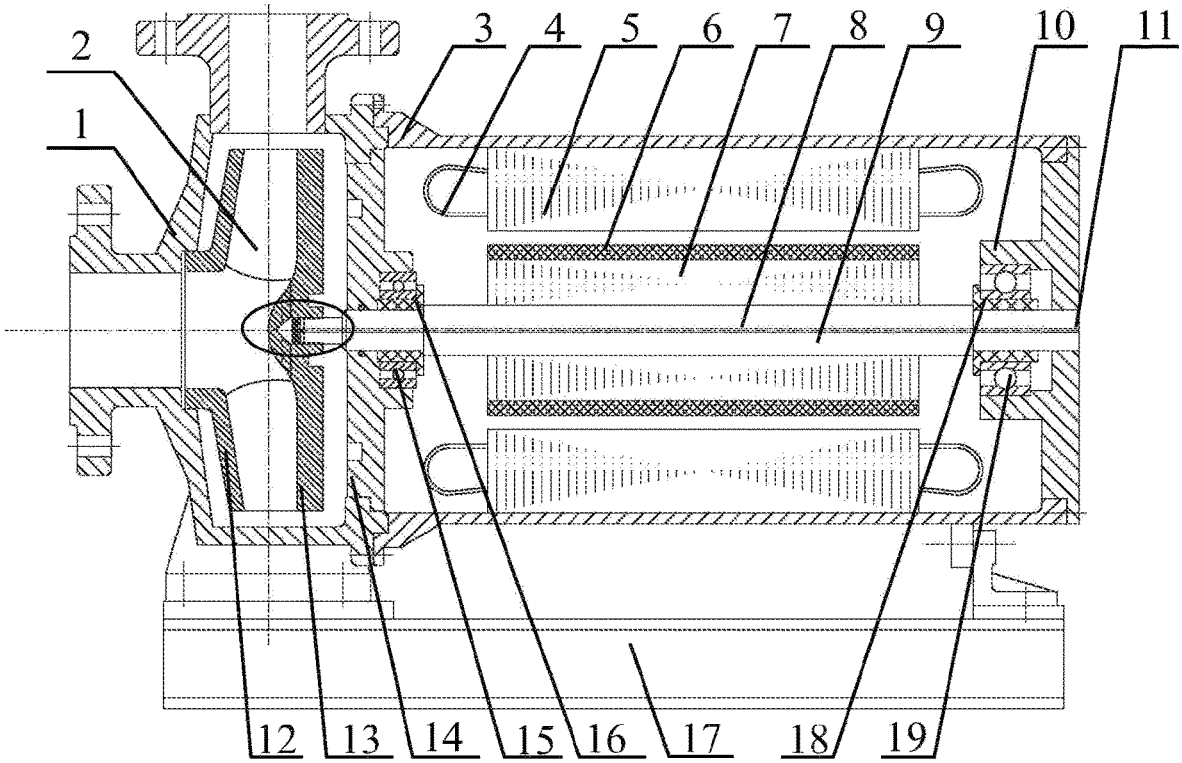
FIG. 1 is a two-dimensional diagram of a permanent magnet direct-drive slurry pump based on gas film drag reduction in an embodiment of the present invention.
Figure 2:
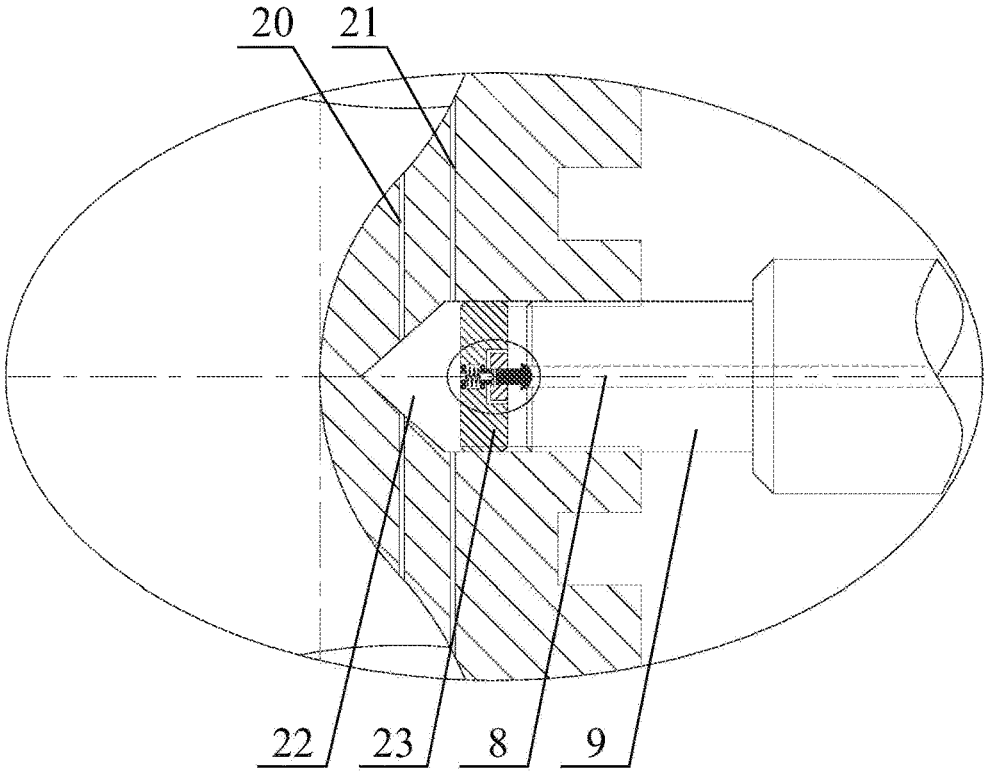
FIG. 2 is a partial enlarged diagram of a tail end of a main shaft in an embodiment of the present invention.
Figure 3:
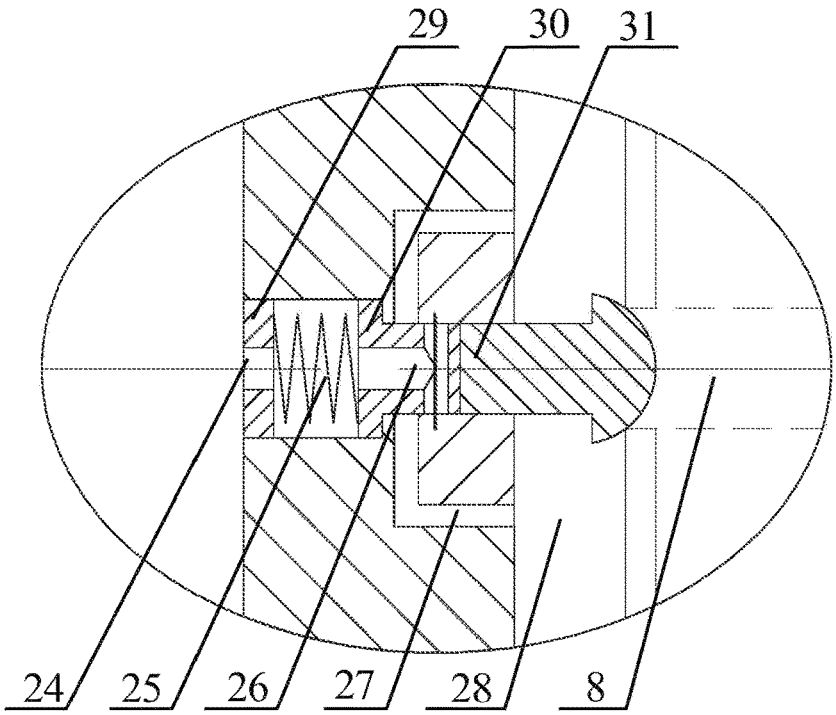
FIG. 3 is a partial enlarged diagram of a valve block in an embodiment of the present invention.
Figure 4:
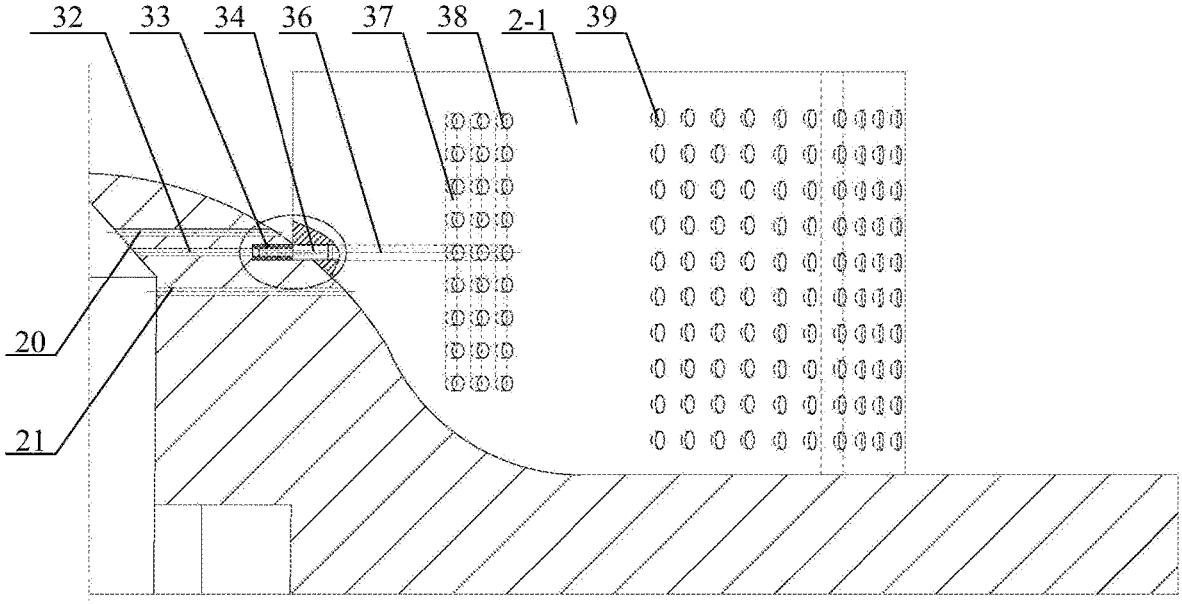
FIG. 4 is a half-sectional diagram of an impeller in an embodiment of the present invention.
Figure 5:
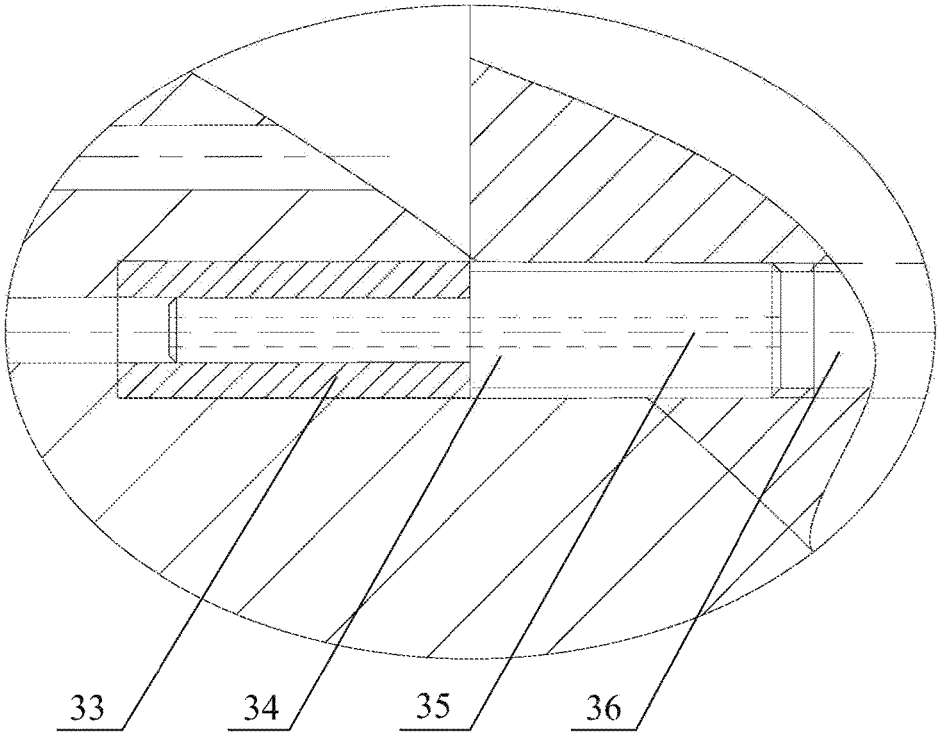
FIG. 5 is a partial enlarged diagram of an insertion rod in an embodiment of the present invention.
Figure 6:
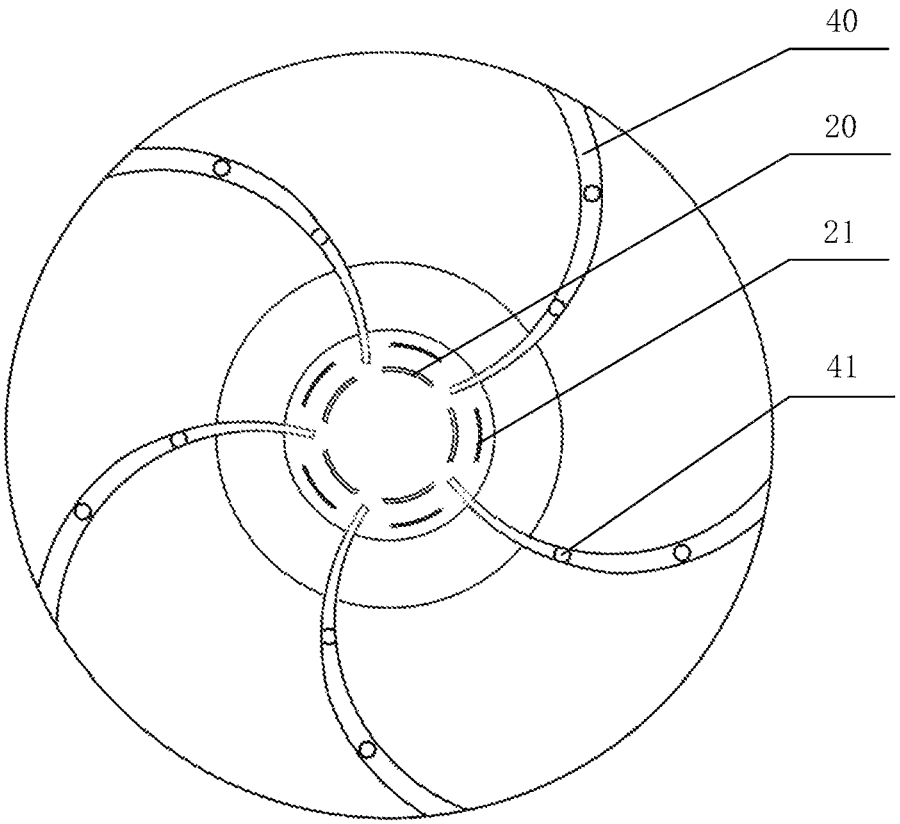
FIG. 6 is a three-dimensional top view of a back cover plate in an embodiment of the present invention.
Figure 7:
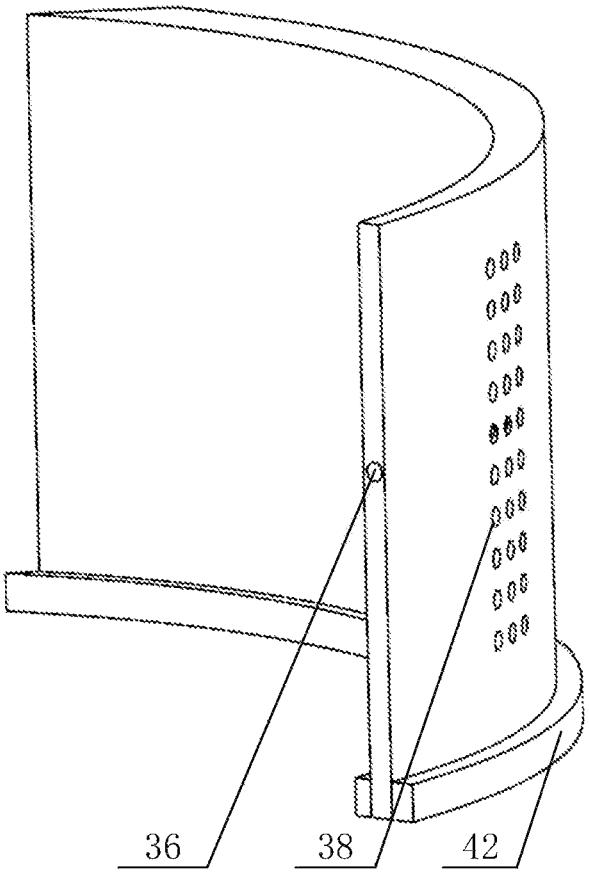
FIG. 7 is a three-dimensional diagram of a blade in an embodiment of the present invention.
Figure 8:
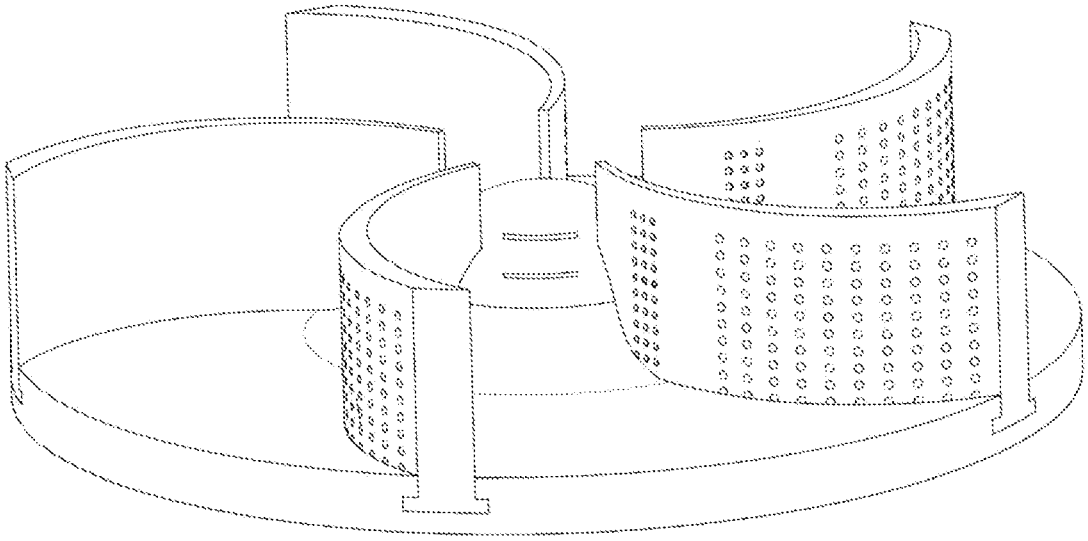
FIG. 8 is a three-dimensional diagram of the impeller in an embodiment of the present invention.

As shown in FIGS. 1 to 8, a permanent magnet direct-drive slurry pump based on gas film drag reduction includes a motor housing 3 of which a front end and a rear end are respectively disposed with a motor front cover 14 and a motor back cover 10. A pump body 1 is further fixed on the front end of the motor housing 3 and a pumping chamber is formed between the pump body 1 and the motor front cover 14. A rotatable main shaft 9 is disposed between the motor front cover 14 and the motor back cover 10, an airflow channel 8 penetrating from front to back is provided inside the main shaft 9, and a rotor core 7 and a permanent magnet 6 are successively sleeved on the outer wall of a middle portion of the main shaft from inside out. A stator core 5 corresponding to the rotor core 7 is disposed on the inner wall of the motor housing 3, and two ends of the stator core 5 are respectively disposed with stator windings 4. A front end of the main shaft 9 extends into the pumping chamber and is threaded-fastened with an impeller 2 of the pump body 1; and a rear end face of the main shaft 9 extends out of the motor back cover 10, and a tail end of the airflow channel 8 is used as a gas inlet 11. A back cover plate 13 of the impeller 2 is provided with a threaded hole which is in a screw-thread fit with the front end of the main shaft 9. A valve block 23 which partitions the threaded hole into a first gas compartment 22 and a second gas compartment 28 is threaded-fastened in the threaded hole. Five evenly distributed blades 2-1 are disposed at a lateral side of the back cover plate 13 that is close to the main shaft 9, and a blade gas inlet passage 36 and several blade gas exhaust passages 37 that are mutually communicated are disposed on each blade 2-1. Several first gas exhaust ports 20 and second gas exhaust ports 21 that respectively penetrate through the first gas compartment 22 and the pumping chamber are provided in the back cover plate 13. Several third gas vents 32 penetrating through the blade gas inlet passage 36 and the first gas compartment 22 are further provided on the back cover plate 13. The pump body 1 and the rear end of the motor housing 3 are both fixed on the base frame 17. The front cover plate 12 and the back cover plate 13 are made by casting, and the front cover plate 12 is welded onto the blades 2-1 by welding to ensure the whole structural stability of the impeller 2.

The valve block 23 includes a block body of which a middle portion is provided with a T-shaped through hole penetrating from front to back, and a slidable three-way pipe 30 which fits into the T-shaped through hole is disposed in the T-shaped through hole. A spring support 29 is fixed at the front end port of the T-shaped through hole, a spring 25 is fixedly connected between the spring support 29 and the three-way pipe 30, and a valve port 24 is provided at the middle of the spring support. A three-way gas hole 26 is provided in the three-way pipe 30, and two longitudinally symmetrical L-shaped gas passages 27 which are separately communicated with the three-way gas hole 26 and the second gas compartment 28 are provided in the block body. A slidable valve core 31 is further disposed at the rear end of the T-shaped through hole, and an end of the valve core 31 that is far away from the three-way pipe 30 is disposed with an arc-shaped cap capable of covering the end port of the airflow channel 8 in the main shaft 9. Under the effect of the gas pressure in the airflow channel 8, the arc-shaped cap pushes the three-way pipe 30 and compresses the spring 25, so that the three-way gas hole 26 is communicated with the L-shaped gas passages 27 and then the first gas compartment 22 is communicated with the second gas compartment 28. Such a structure can effectively control gas exhaust and prevent liquid from entering the shaft.

The front end of the main shaft 9 is rotatably connected to the motor front cover 14 via a first shaft sleeve and a first bearing 15, and the rear end of the main shaft 9 is rotatably connected to the motor back cover 10 via a second shaft sleeve 18 and a second bearing 19.

An insertion rod 34 is threaded-fastened at an end of the blade gas inlet passage 36 that is close to the back cover plate 13, and a hollow insertion rod gas passage 35 is provided in the insertion rod 34. A rubber sleeve 33 is sleeved on an end of the insertion rod that is far away from the blade gas inlet passage 36, and the insertion rod is nested into its corresponding third gas vent 32. The blades 2-1 can be firmly connected on the back cover plate 13 via the rubber sleeve 33, and the insertion rod gas passage 35 can enable communication between the blade gas inlet passage 36 and the first gas compartment 22. The insertion rod 34 effectively ensures that gas can fully enter the blade gas exhaust passages, and assembly is easy.

The first gas exhaust ports 20 and the second gas exhaust ports 21 are disposed at the front edge between two adjacent blades.

The blade gas exhaust passages 37 are disposed at the front edge of a pressure surface of the blade 2-1, and multiple rows of hemispherical pits 39 are provided from a middle section to the tail edge of the blade 2-1. A dynamic pressure effect is produced when a gas film flow passes through the hemispherical pits 39, thus facilitating reduction of drag for the blades 2-1.

A plurality of blade gas-jet holes 38 is provided in each blade gas exhaust passage 37, which can ensure a coverage range of the gas on the blades 2-1 and more uniform coverage of the gas on the blades 2-1.

A bottom end face of the blade 2-1 is disposed with a boss 42, and a T-shaped groove 40 which fits into the boss 42 is disposed on the back cover plate 13. Several mounting holes 41 for axially fixing the blade 2-1 are further provided on the back cover plate 13.

During operation, under the effect of a centrifugal force, the whole flow channel is filled with slurry which is incessantly thrown out. In this case, gas is exhausted from the first gas exhaust ports 20 and the second gas exhaust ports 21 and covers the back cover plate 13 near a side wall surface of the flow channel; and is then ejected from the multiple blade gas-jet holes 38 and covers the pressure surfaces of the blades 2-1 to form a gas film layer. Due to the existence of the gas film, the slurry is isolated from the wall surface, so that a near-wall flow field is changed, thus reducing viscous resistance of the fluid, reducing friction and wear to the blades 2-1, and improving slurry delivery efficiency.

Apparently, those skilled in the art can make various changes and modifications to the present invention without departing from the spirit and scope of the present invention. Thus, if such modifications and variations to the present invention fall within the scope of the appended claims and its equivalent technology, the present invention is also intended to cover these modifications and variations.

What is claimed is:

1. A permanent magnet direct-drive slurry pump based on gas film drag reduction, comprising a motor housing (3) of which a front end and a rear end are respectively disposed with a motor front cover (14) and a motor back cover (10), wherein a pump body (1) is further fixed on the front end of the motor housing (3) and a pumping chamber is formed between the pump body (1) and the motor front cover (14); a rotatable main shaft (9) is disposed between the motor front cover (14) and the motor back cover (10), an airflow channel (8) penetrating from front to back is provided inside the main shaft (9), and a rotor core (7) and a permanent magnet (6) are successively sleeved on an outer wall of a middle portion of the main shaft from inside out; a stator core (5) corresponding to the rotor core (7) is disposed on an inner wall of the motor housing (3), and two ends of the stator core (5) are respectively disposed with stator windings (4); a front end of the main shaft (9) extends into the pumping chamber and is threaded-fastened with an impeller (2) of the pump body (1), and a rear end face of the main shaft (9) extends out of the motor back cover (10); a back cover plate (13) of the impeller (2) is provided with a threaded hole which is in a screw-thread fit with the front end of the main shaft (9); a valve block (23) which partitions the threaded hole into a first gas compartment (22) and a second gas compartment (28) is threaded-fastened in the threaded hole; evenly distributed blades (2-1) are disposed at a lateral side of the back cover plate (13) that is close to the main shaft (9), and a blade gas inlet passage (36) and blade gas exhaust passages (37) that are mutually communicated are disposed on each blade (2-1); first gas exhaust ports (20) and second gas exhaust ports (21) that respectively penetrate through the first gas compartment (22) and the pumping chamber are provided in the back cover plate (13); third gas vents (32) penetrating through the blade gas inlet passage (36) and the first gas compartment (22) are further provided on the back cover plate (13); and the pump body (1) and the rear end of the motor housing (3) are both fixed on a base frame (17).

2. The permanent magnet direct-drive slurry pump based on gas film drag reduction of claim 1, wherein the valve block (23) comprises a block body of which a middle portion is provided with a T-shaped through hole penetrating from front to back, and a slidable three-way pipe (30) which fits into the T-shaped through hole is disposed in the T-shaped through hole; a spring support (29) is fixed at a front end port of the T-shaped through hole, a spring (25) is fixedly connected between the spring support (29) and the three-way pipe (30), and a valve port (24) is provided at middle of the spring support; a three-way gas hole (26) is provided in the three-way pipe (30), and two longitudinally symmetrical L-shaped gas passages (27) which are separately communicated with the three-way gas hole (26) and the second gas compartment (28) are provided in the block body; and a slidable valve core (31) is further disposed at a rear end of the T-shaped through hole, and an end of the valve core (31) that is far away from the three-way pipe (30) is disposed with an arc-shaped cap capable of covering an end port of the airflow channel (8) in the main shaft (9).

3. The permanent magnet direct-drive slurry pump based on gas film drag reduction of claim 1, wherein the front end of the main shaft (9) is rotatably connected to the motor front cover (14) via a first shaft sleeve and a first bearing (15), and a rear end of the main shaft (9) is rotatably connected to the motor back cover (10) via a second shaft sleeve (18) and a second bearing (19).

4. The permanent magnet direct-drive slurry pump based on gas film drag reduction of claim 1, wherein an insertion rod (34) is threaded-fastened at an end of the blade gas inlet passage (36) that is close to the back cover plate (13), and a hollow insertion rod gas passage (35) is provided in the insertion rod (34); a rubber sleeve (33) is sleeved on an end of the insertion rod that is far away from the blade gas inlet passage (36), and the insertion rod is inserted into its corresponding third gas vent (32).

5. The permanent magnet direct-drive slurry pump based on gas film drag reduction of claim 1, wherein the first gas exhaust ports (20) and the second gas exhaust ports (21) are disposed at a front edge between two adjacent blades.

6. The permanent magnet direct-drive slurry pump based on gas film drag reduction of claim 1, wherein the blade gas exhaust passages (37) are disposed at a front edge of a pressure surface of the blade (2-1), and multiple rows of hemispherical pits (39) are provided from a middle section to a tail edge of the blade (2-1).

7. The permanent magnet direct-drive slurry pump based on gas film drag reduction of claim 1, wherein a plurality of blade gas jet holes (38) is provided in each blade gas exhaust passage (37).

8. The permanent magnet direct-drive slurry pump based on gas film drag reduction of claim 1, wherein a bottom end face of the blade (2-1) is disposed with a boss (42), and a T-shaped groove (40) which fits into the boss (42) is disposed on the back cover plate (13); and mounting holes (41) for axially fixing the blade (2-1) are further provided on the back cover plate (13).

9. The permanent magnet direct-drive slurry pump based on gas film drag reduction of claim 1, wherein a number of the blades (2-1) is from five to eight.

10. The permanent magnet direct-drive slurry pump based on gas film drag reduction of claim 1, wherein gas outlets of the first gas exhaust ports (20) and the second gas exhaust ports (21) are all disposed at a hub of the cover plate (13) and arranged in two layers from inside to outside, and the two layer of the gas outlets are circumferentially evenly distributed on the hub right opposite a flow channel between two adjacent blades (2-1).

* * * * *